United States Patent [19]

Pirker

[11] 4,159,090

[45] Jun. 26, 1979

[54] RAILWAY SWITCH FOR VIGNOLES RAILS

[75] Inventor: Robert Pirker, Zeltweg, Austria

[73] Assignee: Vereinigte Osterreichische Eisen- und Stahlwerke-Alpine Montan Aktiengesellschaft, Vienna, Austria

[21] Appl. No.: 850,837

[22] Filed: Nov. 11, 1977

[30] Foreign Application Priority Data

Feb. 11, 1977 [AT] Austria ..... 935/77

[51] Int. Cl.[2] ..... E01B 7/14

[52] U.S. Cl. ..... 246/391; 246/392; 246/430

[58] Field of Search ..... 246/391, 392, 422, 430, 246/415 R, 351, 353, 381; 104/103

[56] References Cited

U.S. PATENT DOCUMENTS 3,977,635 8/1976 Pirker ..... 246/391

*Primary Examiner*—George E. A. Halvosa
*Assistant Examiner*—Reinhard J. Eisenzopf
*Attorney, Agent, or Firm*—Cushman, Darby & Cushman

[57] ABSTRACT

Railway switch for Vignoles rails, comprising a frog tip and a pair of wing rails arranged for swivelling movement, one of said wing rails engaging the frog tip in its end position and being supported in this position in direction of engaging the frog tip by means of movable supporting members resting against the railway sleepers, noting that the movement of the supporting members and of the wing rails is being effected in mutual dependence, that the supporting members are guided on the railway sleepers in longitudinal direction of the corresponding wing rails and are cooperating with abutments protruding from the wing rails and preferably being fixed to the web of the wing rails, and that the supporting members are formed of one supporting rod for each associated wing rail, said supporting rod comprising, in addition to the supporting surfaces serving for supporting the abutments, recesses giving free the wing rails, characterized in that the push-rod serving the purpose of switching over the railway switch comprises abutments into the shifting path of which a portion of the supporting rods or a part rigidly connected to the supporting rods is protruding as long as the supporting rod considered assumes a position in which the supporting rod is giving free the abutments of the associated wing rail, noting that the supporting rod considered or the part rigidly connected to said supporting rod, respectively, gives free the shifting path of these abutments only when the supporting rod considered assumes its supporting position.

4 Claims, 5 Drawing Figures

RAILWAY SWITCH FOR VIGNOLES RAILS

The present invention refers to a railway switch for Vignoles rails, comprising a frog tip and a pair of wing rails arranged for swivelling movement, one of said wing rails engaging the frog tip in its end position and being supported in this position in direction of engaging the frog tip by means of movable supporting members resting against the railway sleepers, noting that the movement of the supporting members and of the wing rails is being effected in mutual dependence. In such a known construction, with which the present invention is particularly concerned, the supporting members are guided on the railway sleepers in longitudinal direction of the corresponding wing rails and are cooperating with abutments protruding from the wing rails and preferably being fixed to the web of the wing rails, noting that the supporting members are formed of one supporting rod for each associated wing rail, said supporting rod comprising, in addition to the supporting surfaces serving for supporting the abutments, recesses giving free the wing rails. By the supporting rod assuming supporting position, the wing rail just contacting the frog tip is supported in its position of engagement, so that the wing rail resists laterally acting forces exerted by the wheel flanges. Only when shifting the supporting rod such that the recesses of the supporting rod are opposing the abutments of the wing rails and thus are giving free these abutments, the corresponding wing rail can be lifted off the frog tip and the other wing rail is brought into engagement with the frog tip by the supporting rod coordinated to said other wing rail. In railway switches, the correct operating position of all switchable parts such as switch tongues and movable wing rails must be supervised by means of control rods. If the wing rail assumes its correct position but the supporting rod coordinated to these wing rails does not assume its supporting position, the wing rail can be forced out of its engaging position with the frog tip by the wheel flanges, which results in the danger of a derailment. In the known construction the control rod, which can also be designated supervising rod, is therefore connected to the wing rails as well as to the supporting rods coordinated to said wing rails, so that in case of one supporting rod assuming a malposition, which could for instance occur on rupture of a constructional part within the connecting link moving the supporting rod, the supervising equipment indicates such a malposition. This embodiment does, however, require quite a complicated construction for connecting the control rod to the supporting rod.

Now, the invention aims at simplifying the known construction and essentially consists in that the push-rod serving the purpose of switching over the railway switch comprises abutments into the shifting path of which a portion of the supporting rods or a part rigidly connected to the supporting rods is protruding as long as the supporting rod considered assumes a position in which the supporting rod is giving free the abutments of the associated wing rail, noting that the supporting rod considered or the part rigidly connected to said supporting rod, respectively, gives free the shifting path of these abutments only when the supporting rod considered assumes its supporting position. In this manner it becomes impossible to completely switch over the railway switch if the wing rail to be supported in the intended railway switch position is not supported by its associated supporting rod, because in this case the push-rod can only be shifted to such an extent as is allowed by that portion of the supporting rod or of a part rigidly connected to said supporting rod which remains, upon rupture of any constructional part, within the shifting path of the abutment provided of the push-rod. The wing rail disengaging the frog tip cannot be removed from the frog tip for the intended distance (85 mm), so that the control rod associated to said wing rail does not move the supervising slide of the electric drive for a sufficient distance so that the supervising contact (which is in connection with the signalling station or the security device, respectively, for the end position control) cannot fall into the recess provided therefore. In view of a malposition of one supporting rod having as a consequence also a malposition of the wing rail, supervising the end positions of the respective wing rails in the described manner, is also sufficient for supervising the frog as a whole. Therefore, and according to the invention, the control rods, which not only allow to supervise the end positions of the wing rails but also allow to supervise the operationally correct position of the supporting rods, may exclusively be connected to the wing rails, preferably to the base of the wing rails.

The crank levers are, accordingly to a preferred embodiment of the present invention, slidingly engaging recesses of the supporting rods. In view of one arm of the crank lever engaging a recess of the associated supporting rod, the supporting rod can be extended over the point of action of the crank lever, so that the end of the supporting rod or a part rigidly connected thereto can cooperate in a simple manner with the associated abutment of the push-rod.

According to a further advantageous embodiment of the invention the supporting rods are positively guided within eyes of guide members being stationarily arranged at both sides of each of the abutments fixed to the wing rails, noting that the recesses of the supporting rods are formed by openings extending therethrough. By positively guiding the supporting rods, there results a reliable cooperation of the abutments provided on the push-rod with the ends of the supporting rods or with the parts rigidly connected to the ends of the supporting rods. The supporting rods are over their whole lengths guided in the longitudinal direction in such precise a manner that they cannot be moved by the abutments of the push-rod in a direction transverse to their longitudinal direction, thereby increasing reliability.

In view of the recesses of the supporting rods having now the shape of openings extending therethrough, the upper edges of the supporting rods are wholly smooth, so that the supporting rods can be positively guided along the whole surface thereof.

The invention is further illustrated with reference to an embodiment schematically shown in the drawing.

FIG. 1 schematically represents a securely operable railway switch for Vignoles rails with the details for supporting and actuating the switch being omitted.

FIGS. 2*a* and 2*b* each represent a top plan view of a part of the railway switch for Vignoles rails, noting that FIG. 2*a* is representing a top plan view of the frog and FIG. 2*b* represents the top plan view of that part which continues the lefthand part of FIG. 2*a*.

Figure 1:
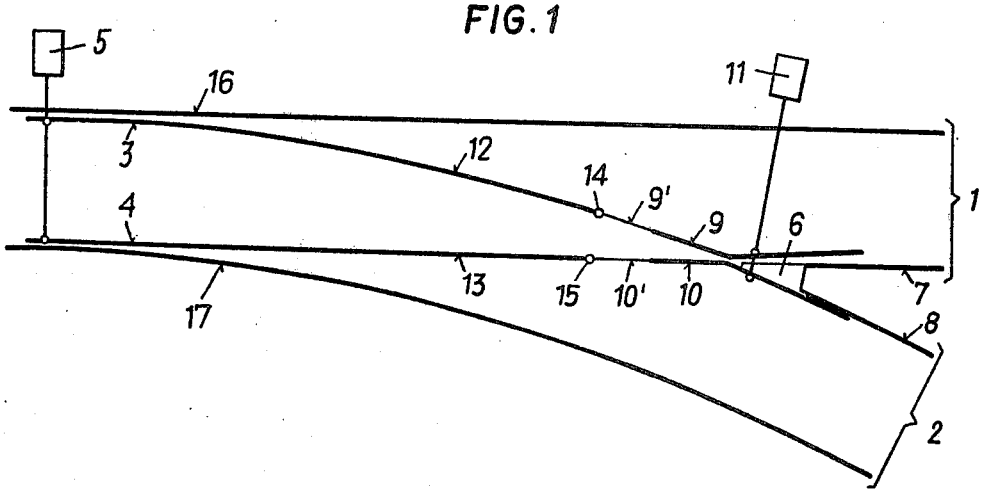
Figure 3:
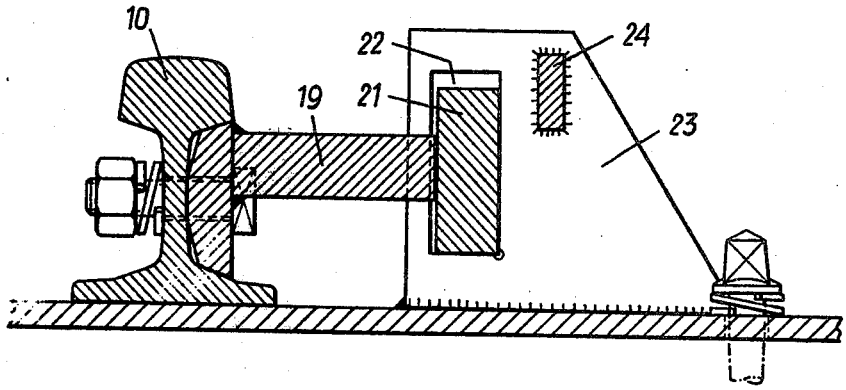
FIG. 3 represents a section along line III—III of FIG. 2*b* in an enlarged scale.

In FIG. 1 the main rail track is designated 1 and the branch rail track is designated 2. The tongue rails are designated 3 and 4 and allow, in dependence on their positions, the main rail track 1 or the branch rail track 2 to be travelled upon. A setting device for the tongue rail is schematically represented at 5. The frog tip is designated 6. The connecting rails 7 and 8 are joined to said frog tip. The wing rails are designated 9 and 10. In the representation of FIG. 1 the straight wing rail 10 is shown in its position engaging the frog tip 6, i.e. the position for travelling on the main rail track, while the bent wing rail 9 is shown in its position moved off the frog tip. The actuating device for actuating the wing rails 9 and 10 is designated 11. The wing rail 9 is connected with the tongue rail 3 via an intermediate rail 12 and the wing rail 10 is connected with the tongue rail 4 via an intermediate rail 13. At the transition areas 14 and 15 between the wing rail 9 and the intermediate rail 12 on the one hand, and between wing rail 10 and the intermediate rail 13 on the other hand, the wing rails are rigidly connected to the railway sleepers. The rail foot of the wing rails 9 and 10 is planed off at the areas 9' and 10' being located adjacent said areas of transition 14 and 15; so that the wing rails can be elastically bent in lateral direction.

The tongue rail 3 or 4 just being travelled upon is pressed against the associated stock rail 16 and 17, respectively, by the pressure of the wheel flange. Any supporting members are thus superfluous at this location. However, the wing rail 9 or 10 just being travelled upon is pressed off the frog tip 6 by the pressure exerted by the wheel flanges. To absorb this load, supporting members are provided.

Figure 2A:
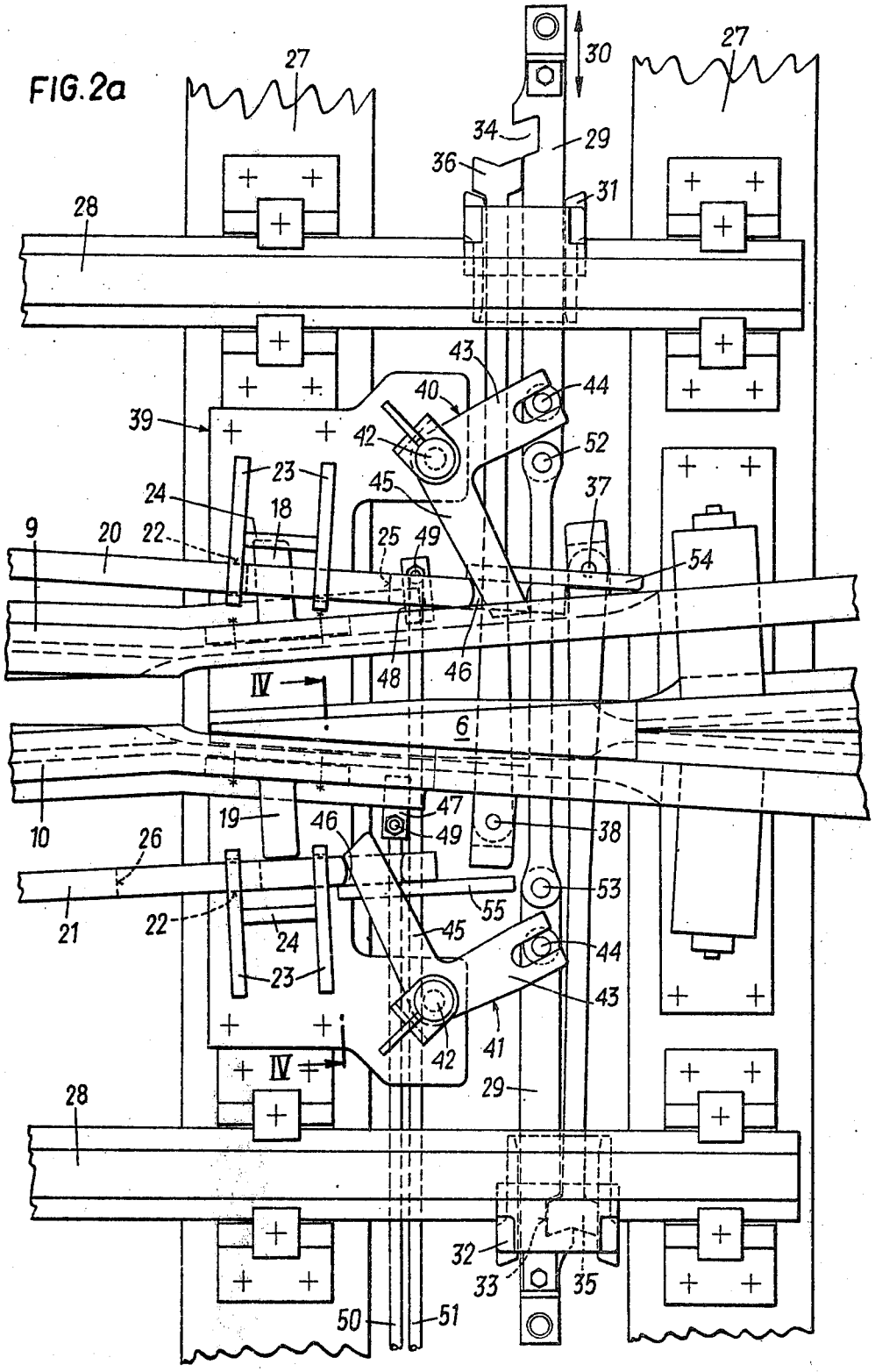
Figure 2B:
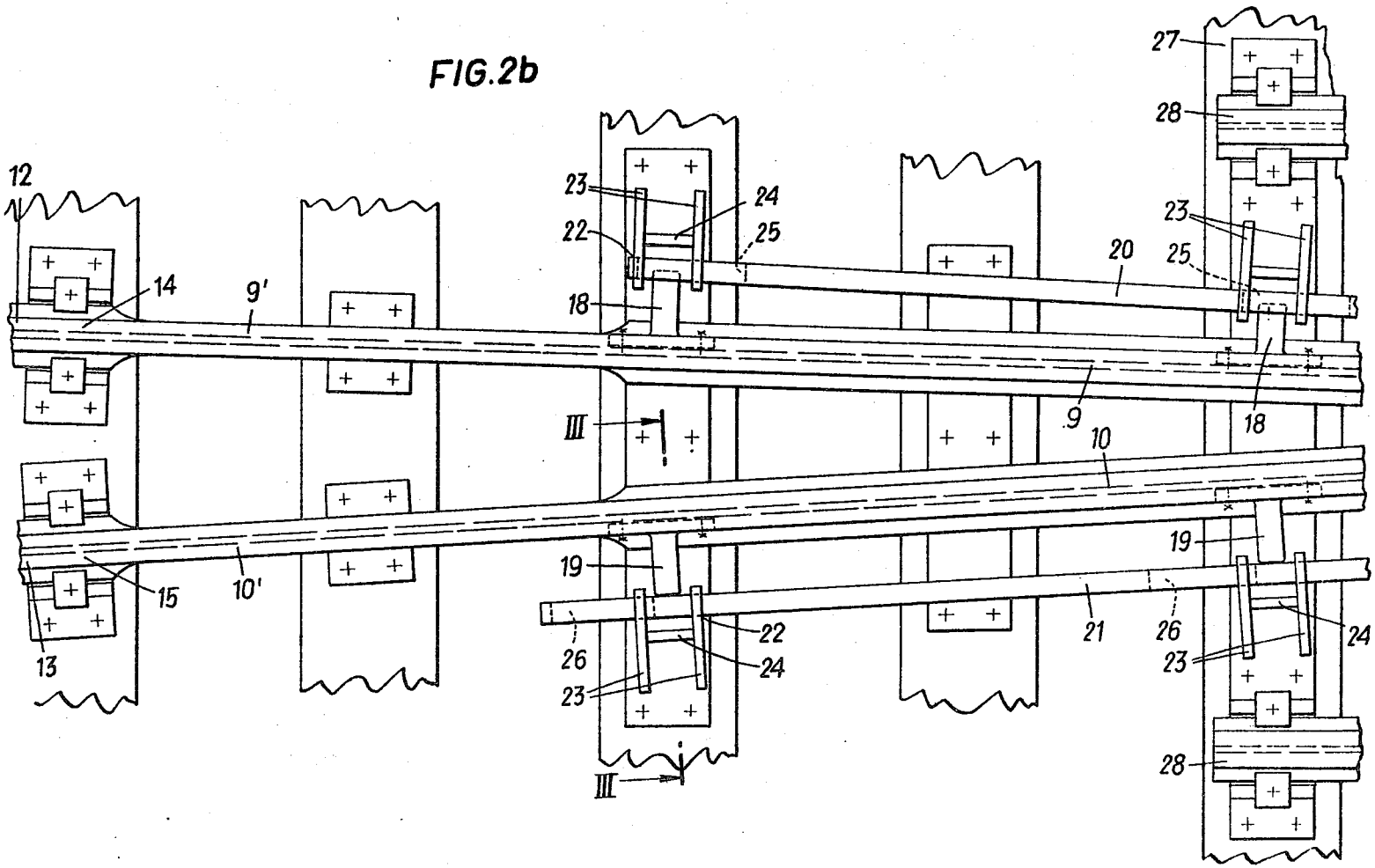

According to FIGS. 2*a* and 2*b*, abutments 18 are, at certain distances, screwed to the rail web of the wing rail 9. Abutments 19 are screwed to the rail web of wing rail 10. 20 and 21 are supporting rods which are guided within eyes of stationarily arranged guiding elements 23. The guiding elements 23 are arranged in pairs on both sides of one abutment 18 and 19, respectively, each and stiffened by a transverse web 24. The supporting rods 20, 21 are longitudinally guided within these guiding elements 23. The supporting rods 20,21 comprise openings 25,26. If these openings are facing the abutments 18, 19 these abutments may enter therethrough and the wing rails 9,10 can be lifted off the frog tip 6 as is shown for the wing rail 9 with associated abutments 18. If the uninterrupted portion of the supporting rods 20,21 is facing the abutments 18, 19, these abutments 18, 19 are supported against the supporting rods 20,21, thus maintaining the wing rail 9 or 10 associated to the respective supporting rod in engagement with the frog tip as is shown for the wing rail 10 and the abutments 19.

Adjustment of the wing rails 9 and 10 is effected by means of a usual clamp lock device. This adjustment device comprises a push-rod 29 which is slidably supported within lock components 31 and 32 in direction of arrow 30. This push-rod 29 comprises recesses 33 and 34 into which clamps 35,36 may enter. Clamp 35 is pivotally connected at 37 to the wing rail 9 while clamp 36 is pivotally connected at 38 to the wing rail 10. With the push-rod 29 shifted in upward direction, based on the representation shown in FIG. 2*a*, clamp 35 is located within the lock component 32 and thus secured in position, so that the wing rail 9 is kept distant from the frog tip 6. Under this condition, clamp 36 is located above the lock component 31 and thus pulling the wing rail 10 into engagement with the frog tip 6. When shifting the push-rod 29 in downward direction, based on the representation shown in FIG. 2*a*, clamp 35 is pulled first in downward direction until the clamp leaves the lock component 32, noting that the wing rail 9 comes close to the frog tip 6. Subsequently, clamp 36 enters the recess 34 of the push-rod 29 and is maintained in this position by being shifted into the lock component 31, so that the wing rail 10 is being lifted off the frog tip. Meanwhile the wing rail 9 contacts the frog tip 6.

Several railway sleepers 27 are connected to a single unit by means of rail lengths 28. On one of these railway sleepers 27 a plate member 39 is fixed and crank levers 40 and 41 are pivotally supported on this plate member 39 by means of pivotal pins 41. One arm 43 of each of said crank levers 40,41 is bifurcated and acting on a bolt 44 upwardly protruding from the push-rod 29. The second arm 45 of each of both crank levers 40,41 enters into openings 46 of the supporting rods 20 and 21, respectively. If the push-rod 29 is, based on the representation shown in FIG. 2*a*, being shifted in downward direction, the crank levers 40,41 are rotated in clockwise direction which results in shifting the supporting rod 20 associated to wing rail 9 in left-hand direction and shifting the supporting rod 21 associated with wing rail 10 in right-hand direction. When shifting the push-rod 29, based on the representation shown in FIG. 2*a*, in upward direction, movement of the individual parts is just in the opposite sense. In this manner, the crank levers 40, 41, the supporting rods 20,21 and the wing rails 9,10 were brought into the position shown in FIG. 2*a*, noting that the wing rail 10 is contacting the frog tip 6, while the wing rail 9 is lifted off this frog tip.

Figure 4:
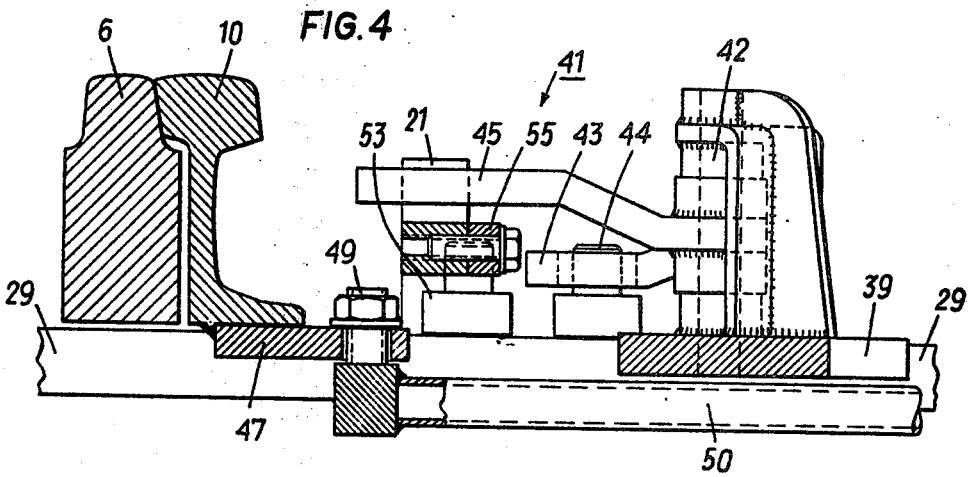
FIG. 4 represents a section along line IV—IV of FIG. 2*a* in an enlarged scale.

A splice strip 47 is welded to the rail foot of the wing rail 10 whereas a splice strip 48 is welded to the rail foot of the wing rail 9. Safety rods 50 and 51 are pivotally connected to these splice strips by means of bolts 49 for indicating via safety equipment whether the wing rail 9 or the wing rail 10 is contacting the frog tip. If wing rail 10 is contacting the frog tip, then, as is illustrated by FIG. 2*a*, the openings 25 within the supporting rod 20 must accommodate the abutments 18 of the wing rail 9 and the supporting rod 21 must support the abutments 19 of the wing rail 10 for reliably securing the wing rail 10 in engaging position with the frog. On account of a fracture of a part of the movement transmission, one of the supporting rods 20,21 could assume a malposition, under which condition reliable supporting of the wing rails 9 or 10 could not be warranted. To make impossible such an operating condition, the push-rod 29 comprises abutments 52 and 53 (see also FIG. 4). An extension member 54 is screwed to and forms a part of the supporting rod 20, whereas an extension member 55 is, screwed to the supporting rod 21. The extension member 55, with the associated supporting rod 21 shifted in right-hand direction as based on FIG. 2*a* and with the openings 26 free of the abutments 19, protrudes, for instance, into the path of the abutment 53. If, for instance, the bolt 44 or the crank lever 40 has become fractured and thus the supporting rod 20 remains in its right-hand position and is not brought in its supporting position on moving the push-rod 29 in downward direction as illustrated by FIG. 2*a*, the abutment 52 of the push-rod 29 will collide with the extension member 54. The wing rail 9 could, however, be brought into contact with the frog tip 6, but the wing rail 10 cannot be lifted off the frog tip for the intended extent (85 mm), because the push-rod 29 cannot be shifted by the electric drive means for the prescribed stroke of 150 mm. In this manner, the safety device, which is being actuated by the control rods 51 and 50, respectively, in its turn only being pivotally connected to the wing rails 9 and 10, respectively, indicates any malposition so that it is not necessary to separately supervise the correct position of the supporting rods 20 and 21.

In view of the arms 45 of crank levers 40,41 are entering the openings 46 provided within the supporting rods 20,21, the end of the supporting rods 20,21 is free for connecting thereto the extension members 54,55.

What we claim is:

1. In a railway switch for Vignoles rails supported on sleepers, said switch being of the kind including a frog tip and a pair of wing rails arranged for swivelling movement, each of said wing rails having a lateral abutment protruding therefrom, one of said wing rails engaging the frog tip in its end position and being supported in this position in direction of engaging the frog tip by means of movable supporting members supported by the railway sleepers, means including a push rod having a reciprocating path of travel for moving the supporting members and the wing rails in mutual dependence, guide means for guiding the supporting members on the railway sleepers in longitudinal direction of the corresponding wing rails so that the supporting members cooperate with the abutments protruding from the wing rails to support the latter, the supporting members being formed of one supporting rod for each associated wing rail, each supporting rod comprising, in addition to the supporting surfaces serving for supporting the respective abutment, a recess which is capable of receiving the abutment on the respective wing rail so as to release the respective wing rail, the improvement wherein the push-rod serving the purpose of switching over the railway switch includes two abutments which are so located that, when one supporting rod is in a position in which the respective wing rail is released and the other supporting rod is in a position in which it supports the abutment on the other wing rail, said one supporting rod protrudes into the path of travel of one of said push-rod abutments and at the same time all portions of said other supporting rod lies outside the path of travel of the other push-rod abutment.

2. A railway switch as claimed in claim 1, including control rods which indicate the operationally safe position of the frog tip, said control rods being exclusively connected to the wing rails.

3. A railway switch as claimed in claim 1, in which the supporting rods are coupled with the push-rod serving for switching over the railway switch via stationarily pivotally supported crank levers which slidingly engage recesses in the respective supporting rods.

4. A railway switch as claimed in claim 1 wherein said guide means for said supporting members have eyes within which said supporting members lie, said guide members being stationarily arranged at both sides of each of the abutments on the wing rails, and wherein said recesses in the supporting rods are formed by openings extending therethrough.

* * * * *